US007845389B2

(12) United States Patent
Zajber et al.

(10) Patent No.: US 7,845,389 B2
(45) Date of Patent: Dec. 7, 2010

(54) METHOD AND DEVICE FOR DYNAMICALLY RESTING ROLLER SEGMENTS THAT SUPPORT AND/OR GUIDE BOTH SIDES OF A CAST BAR MADE OF METAL, PARTICULARLY STEEL

(75) Inventors: Adolf-Gustav Zajber, Langenfeld (DE); Holger Beyer-Steinhauser, Mettman (DE); Christian Geerkens, Jüchen (DE); Axel Weyer, Wuppertal (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/523,600

(22) PCT Filed: Jul. 10, 2003

(86) PCT No.: PCT/EP03/07463

§ 371 (c)(1),
(2), (4) Date: Sep. 26, 2005

(87) PCT Pub. No.: WO2004/018129

PCT Pub. Date: Mar. 4, 2004

(65) Prior Publication Data

US 2006/0151144 A1 Jul. 13, 2006

(30) Foreign Application Priority Data

Aug. 8, 2002 (DE) ..... 102 36 367

(51) Int. Cl.
*B22D 11/128* (2006.01)
*B22D 11/20* (2006.01)

(52) U.S. Cl. ..... 164/454; 164/484; 164/413; 164/442

(58) Field of Classification Search ..... 164/454, 164/484, 413, 442, 480
See application file for complete search history.

(56) References Cited

U.S. PATENT DOCUMENTS

| | | | | |
|---|---|---|---|---|
| 3,358,743 | A | 12/1967 | Adams | |
| 6,102,101 | A * | 8/2000 | Hanazaki et al. | 164/452 |
| 6,386,268 | B1 * | 5/2002 | Weyer et al. | 164/454 |
| 2003/0178171 | A1 * | 9/2003 | Weyer et al. | 164/442 |

FOREIGN PATENT DOCUMENTS

| | | |
|---|---|---|
| DE | 196 27 336 | 9/1997 |
| DE | 101 60 636 | 7/2002 |
| EP | 0 804 981 | 11/1997 |
| WO | 99/46071 | 9/1999 |
| WO | 01/89742 | 11/2001 |
| WO | 02/18077 | 3/2002 |

* cited by examiner

*Primary Examiner*—Kevin P Kerns
(74) *Attorney, Agent, or Firm*—Lucas & Mercanti, LLP; Klaus P. Stoffel

(57) ABSTRACT

A method and continuous casting device for dynamically placing rolling segments against a cast bar made of metal, particularly steel. The continuous casting device is a bloom or billet casting device and has pairs of rollers that are placed against each other in a position-controlled and pressure-controlled manner by piston-cylinder units. The hydraulic pressure is switched from position-controlled operation to pressure-controlled operation when a threshold pressure is reached. The roller segments are arranged in the hot bar zone and the soft reduction zone.

8 Claims, 4 Drawing Sheets

METHOD AND DEVICE FOR DYNAMICALLY RESTING ROLLER SEGMENTS THAT SUPPORT AND/OR GUIDE BOTH SIDES OF A CAST BAR MADE OF METAL, PARTICULARLY STEEL

BACKGROUND OF THE INVENTION

The invention concerns a method and a continuous casting device for the dynamic adjustment of roller segments that support and/or guide both sides of a continuously cast strand made of metal, especially steel, with at least two successive pairs of rollers, which are adjusted relative to each other by piston-cylinder units, which are acted upon with both position control and pressure control, and the pairs of rollers are then adjusted to the continuously cast strand by position control, and the hydraulic pressure is switched from position-controlled operation to pressure-controlled operation when the hydraulic pressure in a piston-cylinder unit reaches a predetermined value.

A method of this type a described in EP 1 062 066 B1. The method was previously used on driver stands of bloom and billet continuous casting machines, in which the hydraulic piston-cylinder units are position-controlled and pressure-controlled. However, the method found no acceptance in other operations, except for slab and thin-slab continuous casting machines.

SUMMARY OF THE INVENTION

The objective of the invention is to expand the previous objective, which was to develop an adjustment method that would avoid damage of the roller segments due to excessive forces and to eliminate bulging of the continuously cast strand as far as possible, by making the method accessible to a larger number of types of continuous casting operations.

In accordance with the invention, this objective is achieved by applying the method to roller segments of continuous bloom and billet casting machines, such that the roller segments are installed in the cold bar zone, the hot bar zone, and/or the soft reduction zone. This allows gentle adjustment of roller segments that is adapted to the given type of operation, even in the case of continuously cast bloom and billet cross sections.

In an advantageous refinement, integrated, driven rollers arranged on the segment entrance side and/or on the segment exit side of swiveling and/or parallel-adjustable roller segments are switched from position-controlled operation to pressure-controlled operation, depending on the phase of the process. This guarantees force or pressure states individually adjusted to the given type of operation.

A continuous casting device for casting continuous bloom or billet sections has a containment roll stand, which is arranged after the continuous casting mold, and a bending-straightening unit.

In accordance with the invention, the process-engineering objective of expanding the method to a larger number of different types of operations is achieved with respect to the equipment by arranging a device at least partially in front of the bending-straightening unit or completely behind the bending-straightening unit, with several hydraulically operated piston-cylinder units with position-controlled or pressure-controlled, adjustable roller segments, each of which has at least one driven roller.

In accordance with other features of the invention, power is transmitted to the continuously cast strand by providing the driven rollers on the segment entrance side and/or on the segment exit side. In this way, with appropriate angular positioning of a roller segment also provided, force is intensively transmitted to the continuously cast strand or the cold bar.

In accordance with other features of the invention, the drives for the driven rollers are designed in such a way that the drive motor for a driven roller is arranged, together with a transfer case, on one side of the segment frame with a vertical drive shaft orientation. In this way the power transmission is direct, and the accessibility of the motors is advantageously simple.

The hydraulic piston-cylinder units and the drive motors for driven rollers are each operated in such a way that the adjustment and automatic regulation concept for the dynamic adjustment is divided into automatic segment control and basic automation.

In this regard the open-loop and/or closed-loop control is further designed in such a way that the automatic segment control comprises at least the given operation strategy, roll spring compensation, a maximum force regulator, a minimum force regulator, and a positioning system. The hydraulic piston-cylinder units optimally adjust the guiding and conveying force for the hot bar, the cold bar (starting bar), and the soft reduction.

Furthermore, in accordance with other features of the invention, the basic automation system comprises at least the given type of operation, a torque controller, and a speed controller. Each driven roller is adjusted to its optimum speed or optimum torque in this way.

In addition, the automatic control of the process is advantageously designed by providing each piston-cylinder unit with two pressure sensors spaced some distance apart for different piston positions and a position sensor for the piston of a piston-cylinder unit. The pressure sensors and position sensor are connected with the automatic segment control system.

Finally, the closed-loop and/or open-loop control is completed by providing for communication between the drive motor for the driven roller and the basic automation system.

The drawings show embodiments of the continuous casting device, which is described in greater detail below and on the basis of which the method of the invention is also described.

DETAILED DESCRIPTION OF THE INVENTION

Figure 1:
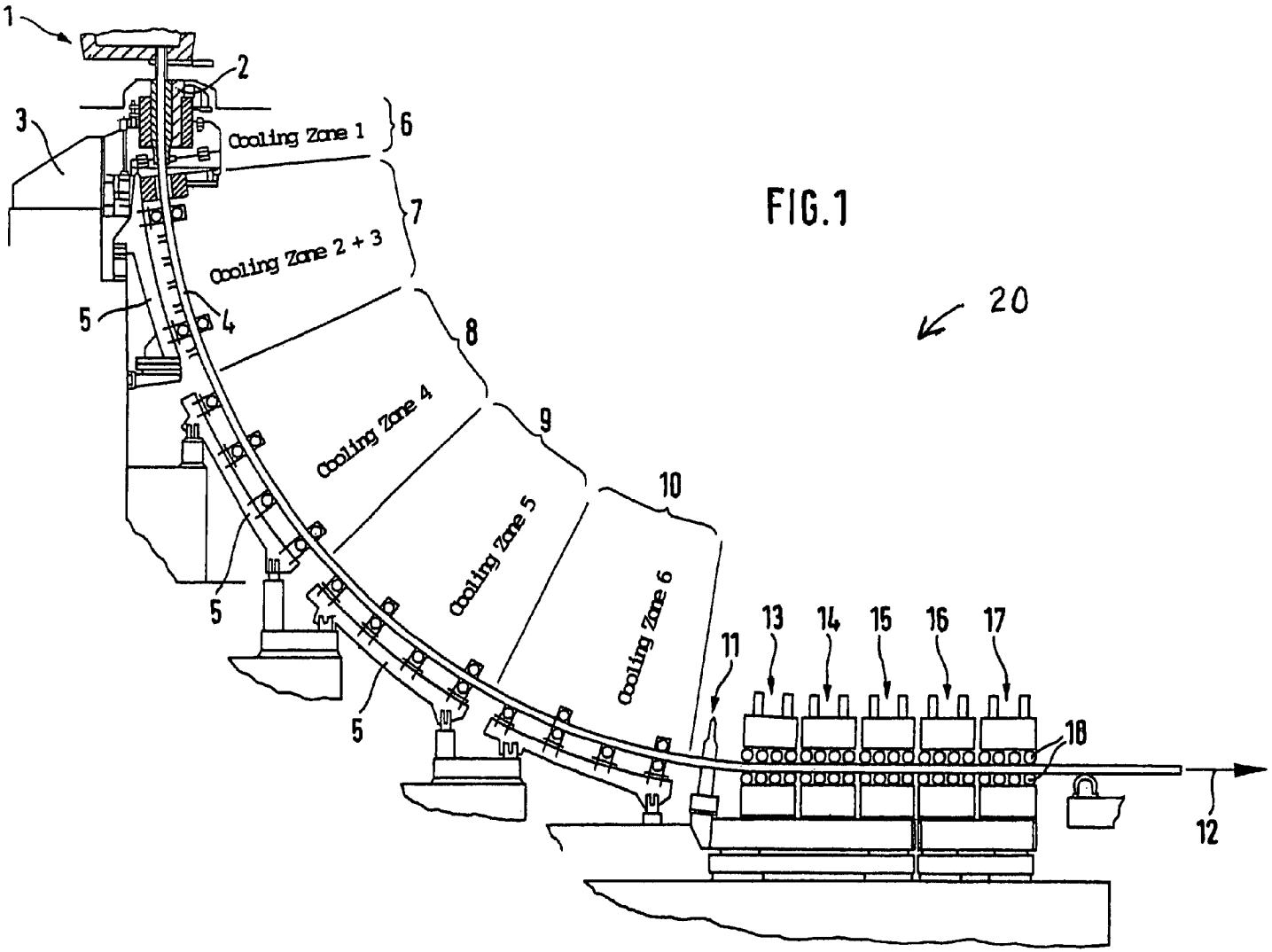
FIG. 1 shows a side view of a continuous casting device for bloom and billet sections.

Molten steel flows from a tundish 1 into a cooled continuous casting mold 2, which is oscillated by an oscillation unit 3 to produce shell solidification of the continuously cast strand 4 leaving the continuous casting mold 2 and prevent sticking. The continuously cast strand 4, which is liquid on the inside and is guided in containment roll stands 5 passes in succession through cooling zones 6, 7, 8, 9, and 10 and then enters a bending-straightening unit 11. Moving in the direction of strand movement 12, the continuously cast strand 4, which has now cooled further, enters roller segments 13, 14, 15, 16, and 17 (FIG. 1).

Each roller segment 13 to 17 has at least two pairs of rollers 18. Each roller segment 13 to 17 is equipped with a pair of piston-cylinder units 19, which, however, are successively arranged on a center line within a roller segment 13 to 17 and adjust only an upper part of the corresponding roller segment, while the lower part is rigidly mounted on the segment frame 13*a* (to 17*a*).

The roller segments 13 to 17, which lie opposite each other in pairs, are adjusted towards each other by the piston-cylinder units 19 under automatic control, and this adjustment is made with both position control and pressure control. In this regard, the pairs of rollers 18 are first set on the continuously cast strand 4 by position control. The contact force is switched from position-controlled operation to pressure-controlled operation as soon as the hydraulic pressure in a piston-cylinder unit 19 has reached a predetermined value.

The method is applied to the roller segments 13 to 17 of bloom and billet continuous casting devices 20, said roller segments 13 to 17 being arranged in the cold bar zone, hot bar zone, and/or soft reduction zone. On the segment entrance side 21 and/or on the segment exit side 22 of the swiveling or parallel-adjustable roller segments, driven rollers 23 integrated in the given segment can be switched from the position-controlled operation to the pressure-controlled operation in the piston-cylinder units 19, depending on the phase of the process or on the type of operation.

Figure 2:
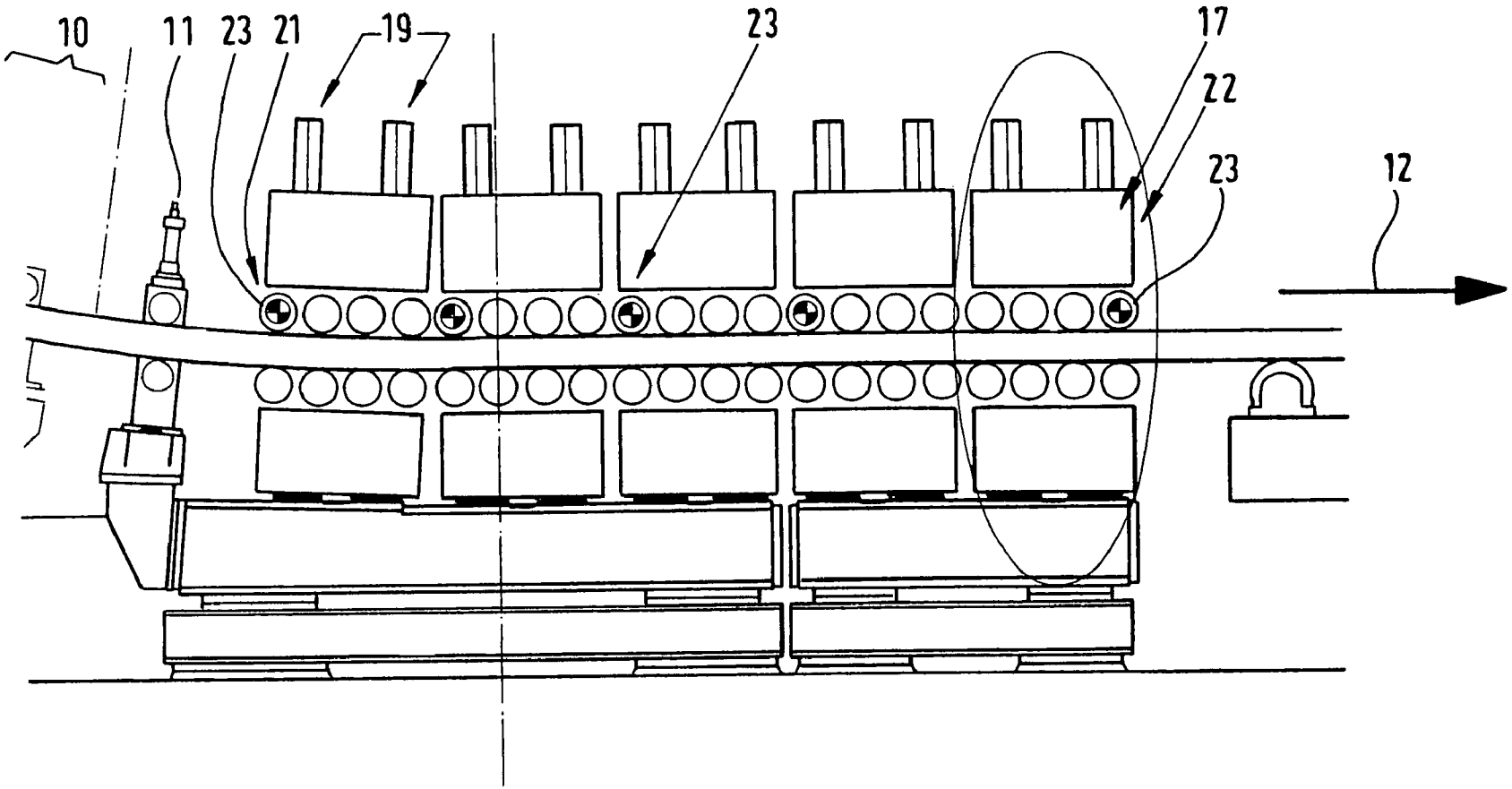
FIG. 2 shows a section of the strand guide segments.

The continuous casting device with the containment roll stand 5, which is arranged after the continuous casting mold 2, and with the bending-straightening unit 11 then has several roller segments 13 to 17, which carry the driven rollers 23 and the piston-cylinder units 19 (FIG. 2).

Figure 3:
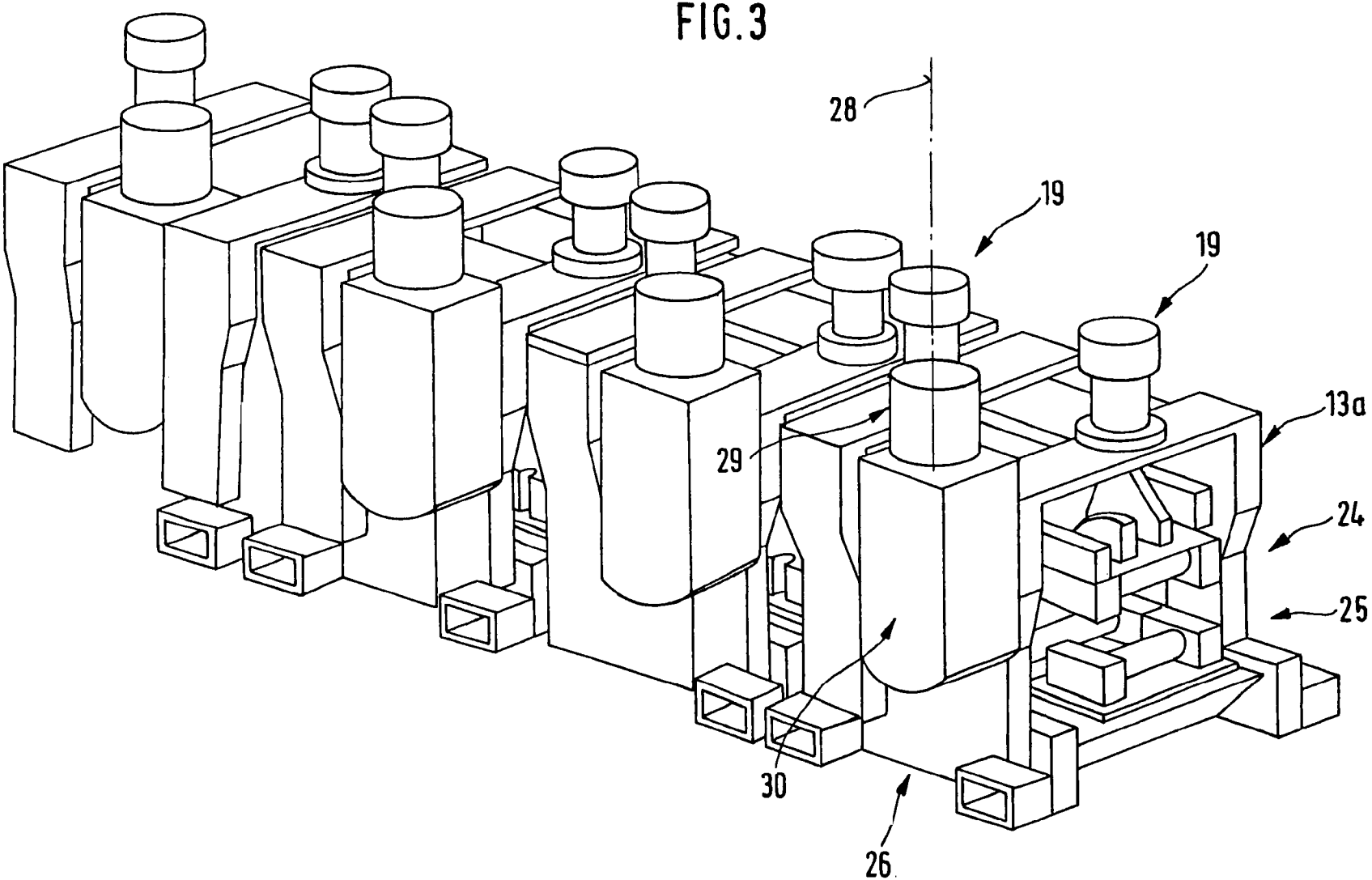
FIG. 3 shows a perspective view of the strand guide segments in segmental construction.

Each roller segment 13 to 17 has the piston-cylinder unit 19 on an upper roller conveyor 24, which lies opposite a lower, fixed roller conveyor 25. On one side 26, a drive motor 29 with transfer case 30 is arranged with a vertical drive shaft orientation 28 (FIG. 3).

Figures 4, 5, 6:
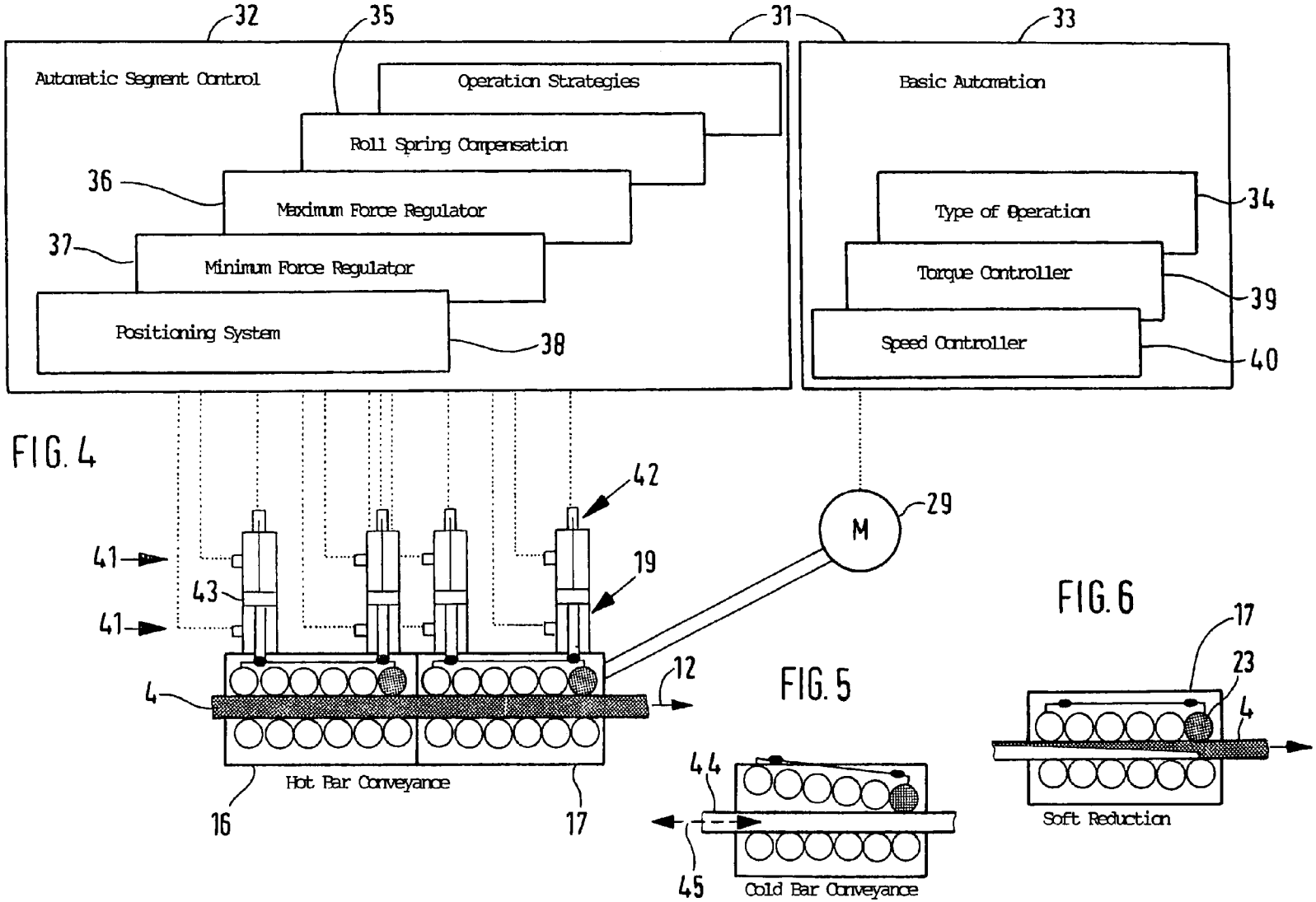
FIG. 4 shows a functional block diagram of the adjustment-control concept connected to a hot bar conveyance system.
FIG. 5 shows the adjustment-control concept for the cold bar conveyance system.
FIG. 6 shows the adjustment-control concept for a soft reduction zone.

FIGS. 4, 5, and 6 show an adjustment and automatic control concept 31. From the standpoint of automatic control engineering, the concept is divided into automatic segment control 32 and basic automation 33. The automatic segment control 32 comprises the given type of operation 34, roll spring compensation 35, a maximum force regulator 36, a minimum force regulator 37, and a positioning system 38.

The basic automation system 33 comprises at least the given type of operation 34, a torque controller 39, and a speed controller 40.

Pressure sensors 41 spaced some distance apart for piston positions and a position sensor 42 for the piston 43 of a piston-cylinder unit 19 are provided on each piston-cylinder unit 19. The pressure sensors and position sensor are connected with the automatic segment control system.

The drive motor 29 for a driven roller 23 communicates with the basic automation system 33 (FIG. 4).

FIG. 5 shows the transmission of power to a cold bar 44, which is moved in the run-in and runout directions 45.

FIG. 6 shows a suitable angular position for a soft reduction of the continuously cast strand 4, the cross section of which has not yet fully solidified.

LIST OF REFERENCE NUMBERS

1 tundish
2 continuous casting mold
3 oscillation unit
4 continuously cast strand
5 containment roll stand
6 cooling zone I
7 cooling zone II+III
8 cooling zone IV
9 cooling zone V
10 cooling zone VI
11 bending-straightening unit
12 direction of strand movement
13 roller segment
13*a* upper frame of segment
14 roller segment
15 roller segment
16 roller segment
17 roller segment
18 pair of rollers
19 piston-cylinder unit
20 bloom and billet continuous casting device
21 segment entrance side
22 segment exit side
23 driven roller
24 upper roller conveyor
25 lower roller conveyor
26 side of the segment frame
27 segment frame
28 drive shaft orientation
29 drive motor
30 transfer case
31 adjustment and automatic control concept
32 automatic segment control system
33 basic automation system
34 type of operation
35 roll spring compensation
36 maximum force regulator
37 minimum force regulator
38 positioning system
39 torque controller
40 speed controller
41 pressure sensor
42 position sensor
43 piston
44 cold bar
45 run-in and runout directions

The invention claimed is:

1. Method for dynamic adjustment of roller segments (13 to 17) that support and/or guide both sides of a continuously cast strand (4) made of metal, with at least two successive pairs of rollers (18), comprising the steps of: adjusting the pairs of rollers (18) relative to each other with piston-cylinder units (19), which are acted upon with both position control and pressure control; subsequently adjusting the pairs of rollers (18) to the continuously cast strand (4) by position control; switching hydraulic pressure from position-controlled operation to pressure-controlled operation when the hydraulic pressure in a piston-cylinder unit (19) reaches a predetermined value; installing the roller segments (13 to 17) in a hot bar zone and a soft reduction zone; and operating the roller segments by an automatic segment control system (32) and a basic automation system (33) so that the method is applied to roller segments (13 to 17) of continuous bloom and billet casting machines (20), wherein in the soft reduction zone the rollers are operated on the billet while the billet is in a semi-solid state, further including installing rotationally driven rollers (23) on the segment entrance side (21) and/or on the segment exit side (22), wherein the driven rollers are driven by drive motors in communication with the basic automation system.

2. Method in accordance with claim 1, further including switching integrated, driven rollers (23) arranged on the segment entrance side (21) and/or on the segment exit side (22) of swiveling and/or parallel-adjustable roller segments (13 to 17) from position-controlled operation to pressure-controlled operation, depending on the phase of the process.

3. Continuous casting device for casting continuous bloom or billet sections, with a containment roll stand (5), which is arranged after a continuous casting mold (2), and with a bending-straightening unit (11), wherein a device is arranged at least partially in front of the bending-straightening unit (11) or completely behind the bending-straightening unit (11), with several hydraulically operated piston-cylinder units (19) with position-controlled or pressure-controlled, adjustable roller segments (13 to 17), each of which has at least one rotationally driven roller (23), wherein the rollers are operated on the billet while the billet is in a semi-solid state, wherein the rotationally driven rollers (23) are installed on the segment entrance side (21) and/or on the segment exit side (22), wherein a drive motor (29) is provided to drive one of the driven rollers (23), and wherein a basic automation system (33) is in communication with the drive motor (29).

4. Continuous casting device in accordance with claim 3, wherein a drive motor (29) for a driven roller (23) is arranged, together with a transfer case (30), on one side (26) of the segment frame (27) with a vertical drive shaft orientation (28).

5. Continuous casting device in accordance with claim 3, wherein an adjustment and automatic control concept (31) for dynamic adjustment is divided into an automatic segment control system (32) and a basic automation system (33).

6. Continuous casting device in accordance with claim 5, wherein the automatic segment control system (32) comprises at least a given operation strategy (34, 39, 40), roll spring compensation (35), a maximum force regulator (36), a minimum force regulator (37), and a positioning system (38).

7. Continuous casting device in accordance with claim 5, wherein the basic automation system (33) comprises at least a given type of operation (34), a torque controller (39) and a speed controller (40).

8. Continuous casting device in accordance claim 3, wherein two pressure sensors (41) spaced some distance apart for different piston positions and a position sensor (42) for a piston (43) of a piston-cylinder unit (19) are provided on each piston-cylinder unit (19) and are connected with the automatic segment control system (32).

* * * * *